United States Patent [19]

Yahn

[11] Patent Number: 4,754,501

[45] Date of Patent: Jul. 5, 1988

[54] PROTECTIVE HEADWARE FOR WRESTLERS

[75] Inventor: Donald H. Yahn, Cedar Rapids, Iowa

[73] Assignee: Max L. Bartlett, Cedar Rapids, Iowa

[21] Appl. No.: 13,640

[22] Filed: Feb. 11, 1987

[51] Int. Cl.[4] ..... A42B 1/08

[52] U.S. Cl. ..... 2/424; 2/9; 2/425

[58] Field of Search ..... 2/424, 425, 423, 9, 2/209

[56] References Cited

U.S. PATENT DOCUMENTS

| | | | |
|---|---|---|---|
| 1,023,285 | 4/1912 | White | 2/9 |
| 1,112,358 | 9/1914 | Cline | 2/9 |
| 2,777,127 | 1/1957 | Marietta | 2/424 |
| 2,898,596 | 8/1959 | Keen | 2/425 X |
| 3,513,482 | 5/1970 | Holden | 2/425 X |
| 3,527,461 | 9/1970 | Prater | 2/424 X |
| 3,628,191 | 12/1971 | Douglas | 2/425 X |
| 4,095,294 | 6/1978 | Winterbottom | 2/424 |
| 4,222,122 | 9/1980 | Toms | 2/424 X |

*Primary Examiner*—Louis K. Rimrodt
*Assistant Examiner*—J. L. Olds
*Attorney, Agent, or Firm*—Hill, Van Santen, Steadman & Simpson

[57] ABSTRACT

A protective headware for wrestlers which covers the top of the head and extends downwardly over a portion of the back of the head and down over the face including the nose mouth and ears and then extends under the chin of the wrestler and has an outer flush surface on each side of the head and which is internally formed with indentations into which the ears of the wrestler are received. A backstrap is used to hold the head gear in place and top and mouth ventilating openings are provided for ventilating purposes.

1 Claim, 1 Drawing Sheet

PROTECTIVE HEADWARE FOR WRESTLERS

BACKGROUND OF THE INVENTION

1. Field of the Invention

The present invention relates in general to protective headgear as, for example, for wrestlers and in particular to a novel headgear.

2. Description of the Prior Art

Various athletic protective gear are known as, for example, shown in U.S. Pat. Nos. 2,777,127, 4,446,576, 4,233,689, 4,222,122, 4,315,335, 3,897,597, 3,934,271, 3,327,316 and 2,664,567. Such prior art devices do not include the combination of flush outer surface with indentations for the ears inside the headgear as well as extending substantially under the user's chin as well as down over the back of his head for a certain distance and provides ample ventilation at the top and mouth area as well as a back holding strap.

SUMMARY OF THE INVENTION

The present invention provides a protective headgear for a wrestler which has a portion which extends down over the back of the head and another portion which extends down under the chin of the wrestler and has side portions which are flush on the outside and are formed with indentations into which the wrestler's ears may be received and further includes ventilating openings on the top and at the mouth and which is provided with a backstrap so as to allow the unit to be held in place.

The present invention comprises a molded one piece headgear which is flexible such that the headgear can be opened by moving the opposite sides of the back opening to allow the head to be placed into the headgear after which the flexible headgear then conforms to the user's head and fits partially down over the back of the head as well as under the user's chin and wherein a backstrap is attachable so as to positively hold the headgear in place. Extending portions fit generally around the head at the back of the ears and at the upper back portion of the head and along the backsides of the head.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
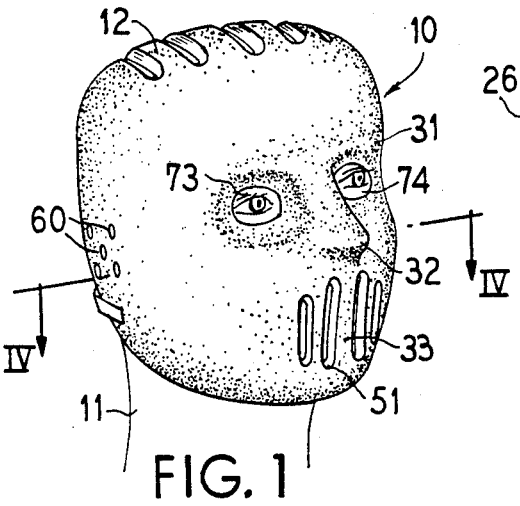
FIG. 1 is a front perspective view of the headgear of the invention.
Figure 2:
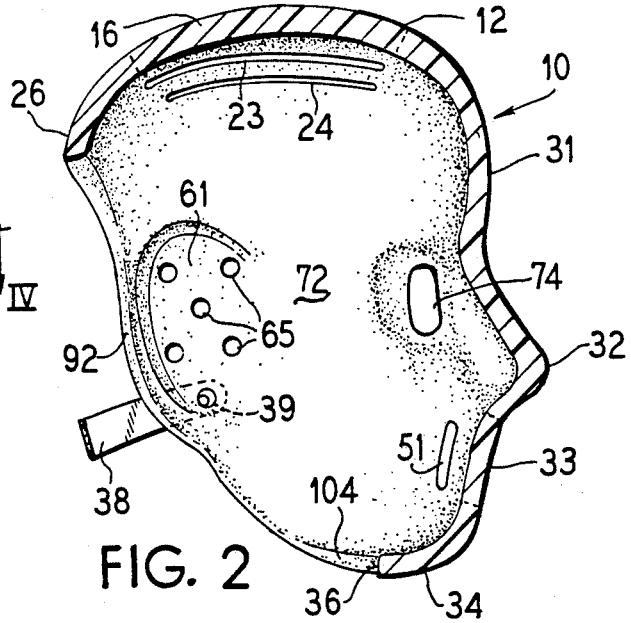
FIG. 2 is a side sectional view of the headgear.
Figure 3:
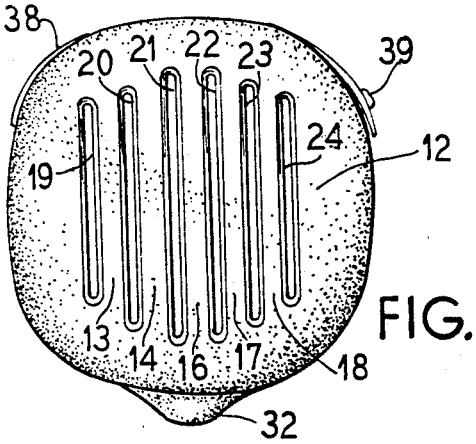
FIG. 3 is a top plan view.

FIG. 1 illustrates a user, as for example, a wrestler 11 wearing the protective headgear 10 of the invention. The protective headgear 10 is formed of a flexible plastic material which can be deformed so as to put the headgear on after which it returns to the undeflected position so as to closely conform to the user's head. The headgear 10, for example, has a top 12 which has a downwardly extending portion 26 that terminates partially behind the back of the top of the user's head and the top is formed with ventilating openings 19, 20, 21, 22, 23 and 24 between longitudinally extending ribs 13, 14, 16, 17, 18 between the openings. The face portion 31 extends down over the face and has eye openings 73 and 74 and a molded nose portion 32. A mouth portion 33 is formed with ventilating openings 51 and a lower portion 34 fits around and under the chin and terminates at an edge 36 which is under the chin of the user.

Side portions 70 and 72 extend downwardly over the ears. Ear portions 61 and 62 are formed with ventilating openings 60 and 65 and the outer surfaces of the ear portions are smooth and conform to the outer portions of the sidewalls 70 and 72 so that no extensions occur at the ear locations on the outer portion of the headgear. Indentations 61 and 62 are made on the inner surfaces of the headgear for receiving the user's ears therein to protect them and also to firmly seat the headgear on the user. A backstrap 38 has one end 41 connected to the headgear and the other end is connected by detachable fastening means 39 to the headgear as shown in FIG. 4.

Figure 4:
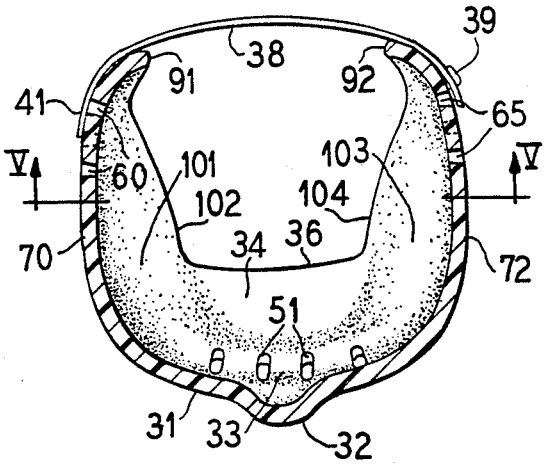
FIG. 4 is a sectional view taken on line IV—IV in FIG. 1.
Figure 5:
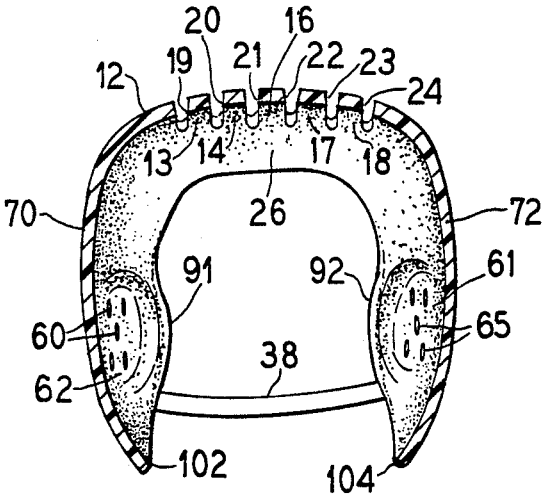
FIG. 5 is a sectional view taken on line V—V from FIG. 4.

As is shown in the sectional view of FIG. 4, the bottom portion 34 terminates at an edge 36 which is under the user's chin and side portions 101 and 103 fit under the side of the chin and terminate at edges 102 and 104. Back edges 91 and 92 extend around the back of the head behind the ear portions 61 and 62 as illustrated.

In use, the fastener 39 is detached from the headgear and the user opens the headgear from the back by pulling apart the rear edges 91 and 92 so that his head can be inserted up into the top portion 12 and so that the chin portion 34 can be inserted under his chin with the side portions 101 and 103 also fitting under the chin. The strap 38 is attached to the headgear by the fastener 39.

The present invention comprises a close fitting protective headgear which has a smooth outer surface and indentations into which the ears may fit on the inside thereof and provides adequate ventilation and protects all portions of the head.

Although the invention has been described with respect to preferred embodiments, it is not to be so limited as changes and modifications can be made which are within the full intended scope of the invention as defined by the appended claims.

I claim as may invention:

1. A protective head gear for a wrestler capable of protecting the head including the ears from shock and injury comprising a helmet portion of flexible shock absorbent material which extends over the top of the head and slightly down the back of the head and over the face and under the chin in the front and on both sides thereof, the sides of said helmet portion extending over the ears and flush on the outside thereof and formed with inside indentations into which the ears are received, and which is put on by pulling apart rear edges so that the head can be inserted, and a back strap attachable to said helmet portion to lock said protective head gear onto the head, including ventilating slots formed in the top of said helmet portion, including ventilating openings formed over the ears in said helmet portion, including slots formed over the mouth portion of said helmet portion, and including a pair of eye openings formed in said helmet portion.

* * * * *